US012246209B1

(12) United States Patent
Wu et al.

(10) Patent No.: US 12,246,209 B1
(45) **Date of Patent: *Mar. 11, 2025**

(54) WEIGHT PLATE

(71) Applicant: Wuyi Boda industry and trade Co., LTD., Jinhua (CN)

(72) Inventors: Zige Wu, Jinhua (CN); Mingkai Wu, Jinhua (CN)

(73) Assignee: Wuyi Boda industry and trade Co., LTD., Jinhua (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/925,042

(22) Filed: Oct. 24, 2024

(30) Foreign Application Priority Data

Sep. 30, 2024 (CN) ..... 202422398943.6

(51) Int. Cl.
*A63B 21/072* (2006.01)
*A63B 21/075* (2006.01)

(52) U.S. Cl.
CPC ..... *A63B 21/0728* (2013.01); *A63B 21/075* (2013.01)

(58) Field of Classification Search
CPC ..... A63B 21/0724; A63B 21/0728; A63B 21/075
See application file for complete search history.

(56) References Cited

U.S. PATENT DOCUMENTS 4,453,710 A * 6/1984 Plotz ..... A63B 21/0728 403/167
5,911,651 A * 6/1999 Liu ..... A63B 21/0728 482/107
6,776,741 B2 * 8/2004 Burwell ..... A63B 21/0728 482/106
7,037,245 B2 * 5/2006 Burwell ..... A63B 21/075 482/106
7,588,520 B2 * 9/2009 Nalley ..... A63B 21/075 482/99
8,790,223 B2 * 7/2014 Wang ..... A63B 21/075 482/106
11,052,276 B1 * 7/2021 Baker ..... A63B 21/0604
11,712,595 B2 * 8/2023 Young ..... A63B 21/0724 482/107
11,794,061 B2 * 10/2023 Yao ..... A63B 21/0728
12,102,866 B2 * 10/2024 Wang ..... A63B 21/0722
12,138,503 B2 * 11/2024 Chen ..... A63B 21/072
(Continued)

*Primary Examiner* — Joshua Lee
(74) *Attorney, Agent, or Firm* — Ying-Ting Chen

(57) ABSTRACT

Disclosed is a weight plate, including a front fixing member, provided with a first snapping portion and a first channel, where the first channel penetrates the first snapping portion and the first snapping portion is provided with a first snapping recess; a rear fixing member, fixedly connected to the front fixing member and provided with a second channel; a snapping module, movably disposed between the front fixing member and the rear fixing member, where the first snapping portion of an adjacent weight plate is capable of being inserted into the second channel to be snapped with the snapping module; a pressing module, movably connected to the front fixing member through the first channel, to drive the snapping module to open and close; and a first limiting sleeve, sleeved on the pressing module and fixedly connected to the front fixing member, for limiting a maximum stroke of the pressing module.

18 Claims, 7 Drawing Sheets

(56) References Cited

U.S. PATENT DOCUMENTS

| | | | | |
|---|---|---|---|---|
| 2022/0401789 | A1* | 12/2022 | Li | A63B 21/0724 |
| 2023/0173326 | A1* | 6/2023 | Yao | A63B 21/0728<br>482/107 |
| 2023/0173327 | A1* | 6/2023 | Wang | A63B 21/075<br>482/107 |
| 2023/0285794 | A1* | 9/2023 | Zhou | A63B 21/0724 |
| 2024/0181288 | A1* | 6/2024 | Chen | A63B 21/0728 |
| 2024/0285996 | A1* | 8/2024 | Choudhury | A63B 21/075 |

* cited by examiner

WEIGHT PLATE

CROSS-REFERENCE TO RELATED APPLICATIONS

This application claims priority to Chinese Patent Application No. 202422398943.6, filed on Sep. 30, 2024, which claims priority to Chinese Patent Application No. 202421038365.9, filed on May 14, 2020, the contents of which are incorporated herein by reference in their entirety.

TECHNICAL FIELD

The disclosure relates to the technical field of fitness devices, and more particularly to a weight plate.

BACKGROUND

Dumbbells are a kind of auxiliary equipment for weight-lifting and fitness exercises, smaller than barbells, the weight of the light dumbbells is 6, 8, 12, 16 pounds, etc., The weight of the heavy dumbbells is 10, 15, 30 kilograms, etc., so favored by the majority of fitness enthusiasts, because there is no sound during the exercise, named dumbbells.

There are two main kinds of dumbbells in the related art: a dumbbell with fixed weight and a dumbbell with adjustable weight. When the former dumbbell with fixed weight is used, a set of dumbbells with different weights must be prepared to meet the needs of trainers. The latter is deeply welcomed by athletic trainers because the weight can be adjusted.

In the related art, most of the weight-adjustable dumbbells are complex in structure, cannot quickly increase or reduce weight or cannot independently adjust the weight of two ends, or are very expensive. Therefore, there is an urgent need for a dumbbell that can be quickly adjusted and has a low cost to meet the needs of the majority of sports fans.

SUMMARY

According to an embodiment of the present disclosure, a weight plate is provided and comprises:

- a front fixing member, provided with a first snapping portion and a first channel, where the first channel penetrates the first snapping portion and the first snapping portion is provided with a first snapping recess;
- a rear fixing member, fixedly connected to the front fixing member and provided with a second channel;
- a snapping module, movably disposed between the front fixing member and the rear fixing member, where the first snapping portion of the adjacent weight plate is capable of being inserted into the second channel to be snapped with the snapping module;
- a pressing module, movably connected to the front fixing member through the first channel, to drive the snapping module to open and close; and
- a first limiting sleeve, sleeved on the pressing module and fixedly connected to the front fixing member, for limiting a maximum stroke of the pressing module, where a pair of first sliding slots and a pair of second sliding slots are disposed on two opposite sides of the first limiting sleeve.

Optionally, the snapping module comprises:

- a pair of first snapping members, where an upper end of each of the first snapping members is provided with a first driving portion and a lower end of each of the first snapping members is provided with a second snapping portion, the first driving portion is connected to the pressing module, the second snapping portion is connected to the first snapping recess of the adjacent weight plate; and
- a pair of first elastic members, where the pair of first elastic members are one-to-one corresponding to the pair of first snapping members, and are disposed between the corresponding first snapping members and the front fixing member or the rear fixing member, for resetting the corresponding first snapping member.

Optionally, the first snapping member is provided with a first limiting slot and one end of the corresponding first elastic member is provided in the first limiting slot.

Optionally, the first snapping member is provided with a first limiting protrusion and a pair of second limiting slots;

- where the first limiting protrusion is disposed on a lower side of the first snapping member and the pair of second limiting slots are disposed at two ends of the first limiting protrusion.

Optionally, the pressing module comprises:

- a button capable of being reciprocated and sliding inside the first channel;
- at least one pressing member, where one end of the pressing member is fixedly connected to the button, and the other end of the pressing member is tapered and connected to the snapping module;
- a pair of second snapping members, where the pair of second snapping members are respectively disposed on two sides of the pressing member, one end of each of the second snapping members is fixedly connected to the button, and the other end of each of the second snapping members is snapped with the front fixing member to prevent the pressing member from detached from the first channel; and
- a second elastic member, where one end of the second elastic member is connected to the button, and the other end of the second elastic member is connected to the front fixing member, for resetting the button.

Optionally, the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

Optionally, the front fixing member is further provided with at least one second limiting protrusion and the rear fixing member is provided with a third limiting slot coupled with the second limiting protrusion.

Optionally, the weight plate further comprises a weight assembly connected to the front fixing member and/or the rear fixing member and a weight of the weight assembly is adjustable.

Optionally, the weight plate further comprises a protective cover sleeved on the weight assembly.

Optionally, the front fixing member and/or the rear fixing member are provided with a fourth limiting slot and the snapping module is provided inside the fourth limiting slot.

The weight plate according to the embodiment of the disclosure has the advantages of simple structure and low cost. A plurality of weight plates can be snapped to each other, which has strong adaptability and replaceability. The weight for the bodybuilder can be adjusted by adjusting the number of the snapped weight plates. At the same time, the weight of one single weight plate can be controlled by adjusting the quality of the weight assembly.

It is to be understood that the foregoing general description and the following detailed description are exemplary and are intended to provide further illustration of the claimed technology.

DETAILED DESCRIPTION OF THE EMBODIMENTS

Figure 1:
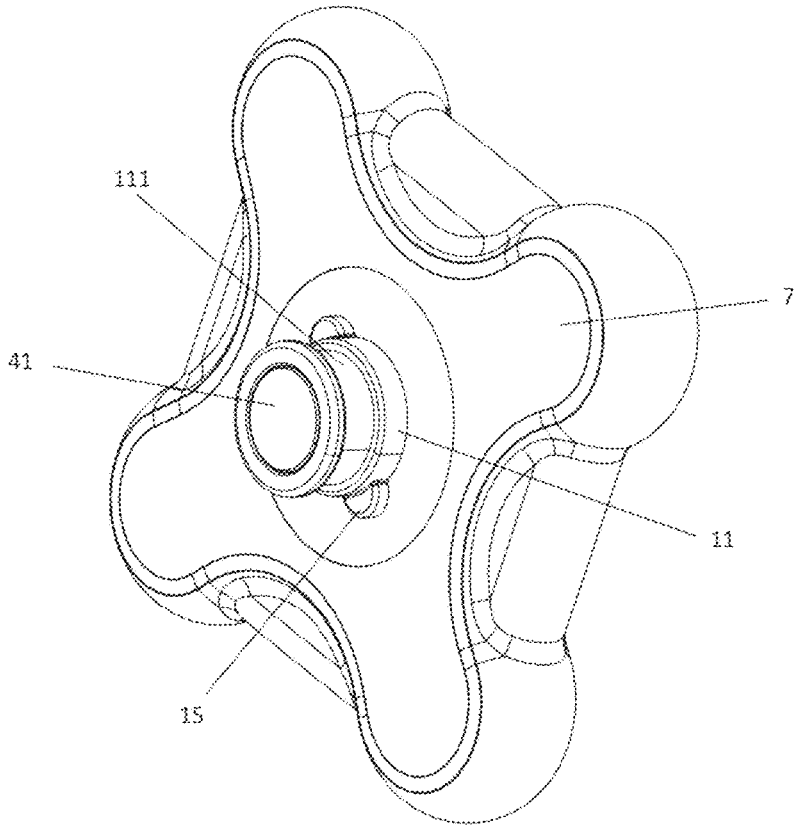
FIG. 1 is a schematic perspective view of a weight plate according to an embodiment of the present disclosure.
Figure 2:
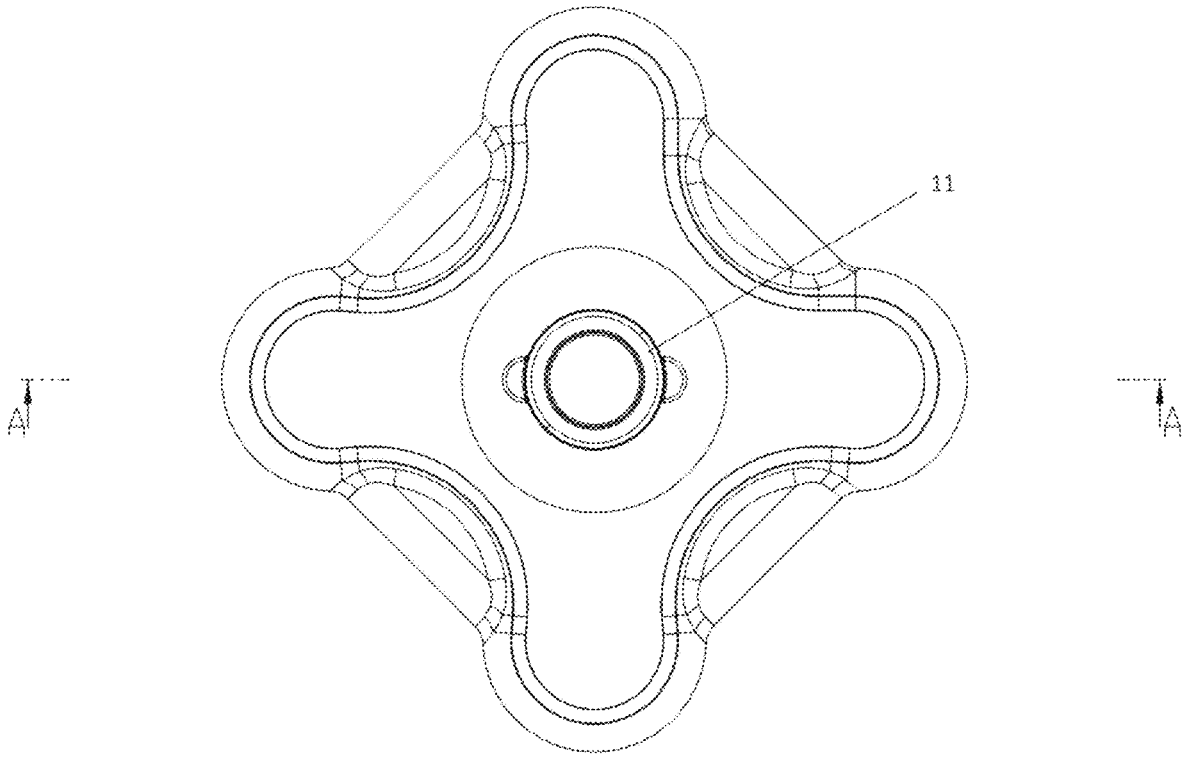
FIG. 2 is a front view of the weight plate according to the embodiment of the present disclosure.

Hereinafter, the embodiment of the present disclosure will be described in detail with reference to the accompanying drawings, and the present disclosure will be further illustrated.

First, a weight plate according to an embodiment of the present disclosure will be described with reference to FIGS. 1 to 12, which is used in fitness devices such as dumbbells, barbells, or kettlebells with wide application scenarios.

As shown in FIGS. 1 to 12, the weight plate according to the embodiment of the present disclosure comprises:

- a front fixing member 1, provided with a first snapping portion 11 and a first channel 12, where the first channel 12 penetrates the first snapping portion 11 and the first snapping portion 11 is provided with a first snapping recess 111;
- a rear fixing member 2, fixedly connected to the front fixing member 1, where the rear fixing member 2 is provided with a second channel 21;
- where the front fixing member 1 and the rear fixing member 2 can be fixedly connected by screws;
- a snapping module 3, movably disposed between the front fixing member 1 and the rear fixing member 2, where the first snapping portion 11 of the adjacent weight plate can be inserted into the second channel 21 to snap with the snapping module 3;
- a pressing module 4, movably connected to the front fixing member 1 through the first channel 12, to drive the snapping module 3 to open and close; and
- a first limiting sleeve 5, sleeved on the pressing module 4 and is fixedly connected to the front fixing member 1, for limiting the maximum stroke of the pressing module 4, where a pair of first sliding slots 51 and a pair of second sliding slots 52 are provided on two opposite sides of the first limiting sleeve 5.

Optionally, as shown in FIGS. 3 to 4, 6, and 8 to 9, in the present embodiment, the snapping module 3 comprises:

- a pair of second engaging members 31, provided with a first driving portion 311 at an upper end of the second engaging member 31 and a second snapping portion 312 at a lower end of the second engaging member 31, where the first driving portion 311 is connected to the pressing module 4 and the second snapping portion 312 can be connected to the first snapping recess 111 of the adjacent weight plate; and
- a pair of first elastic members 32, where the pair of first elastic members 32 and the pair of first snapping members 31 correspond one-to-one, the pair of first elastic members 32 are provided between the corresponding first snapping members 31 and the front fixing member 1 or the rear fixing member 2, for resetting the corresponding first snapping members 31, and the first elastic members 32 are springs optionally.

Figure 3:
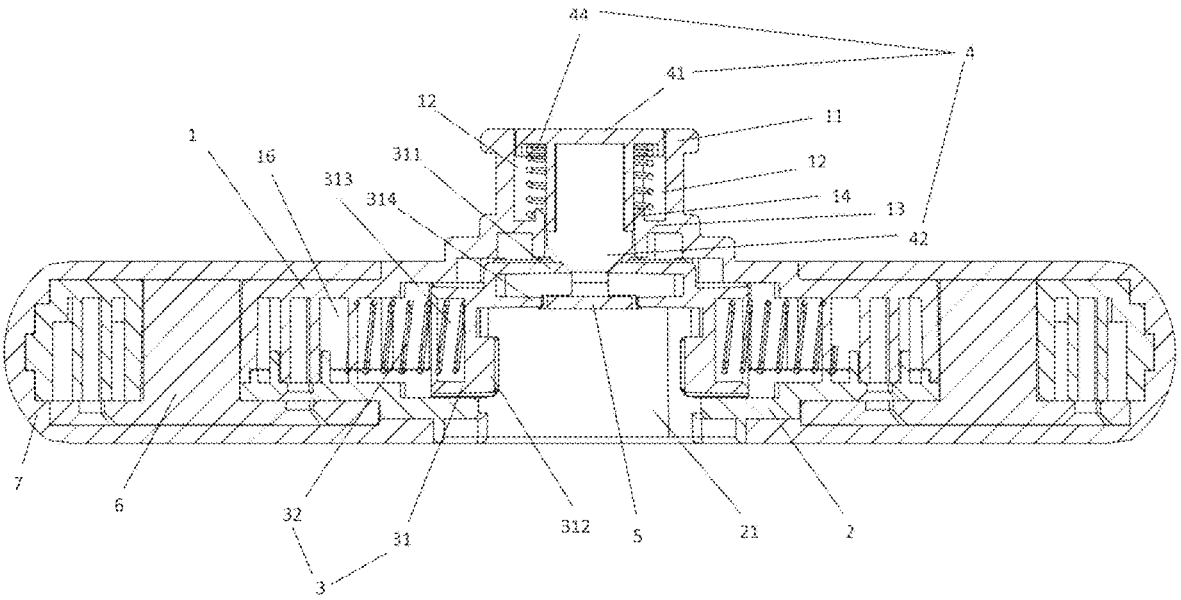
FIG. 3 is a cross-sectional view taken along line A-A of FIG. 2.
Figure 4:
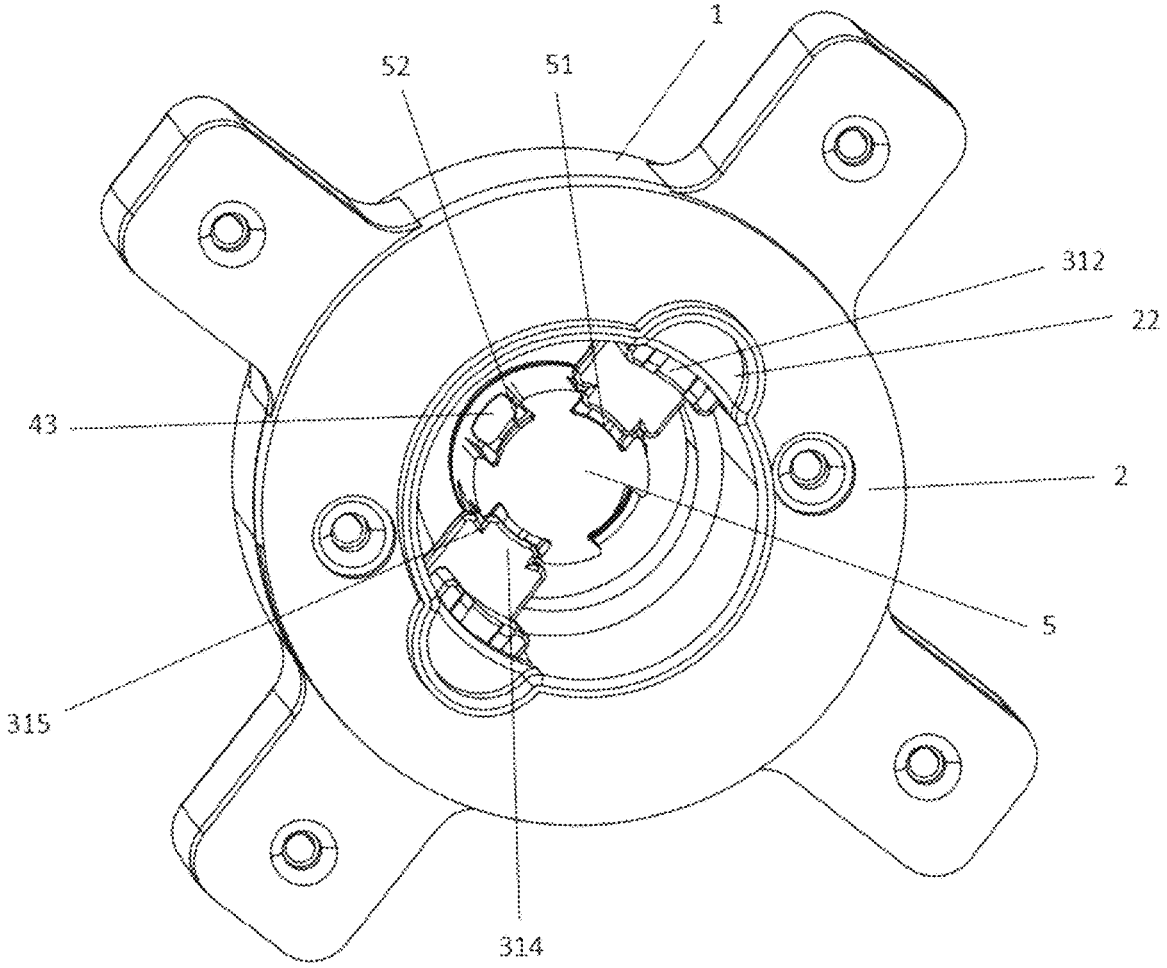
FIG. 4 is a schematic perspective view of the weight plate according to the embodiment of the present disclosure after the protective cover and the weight assembly are removed.
Figure 5:
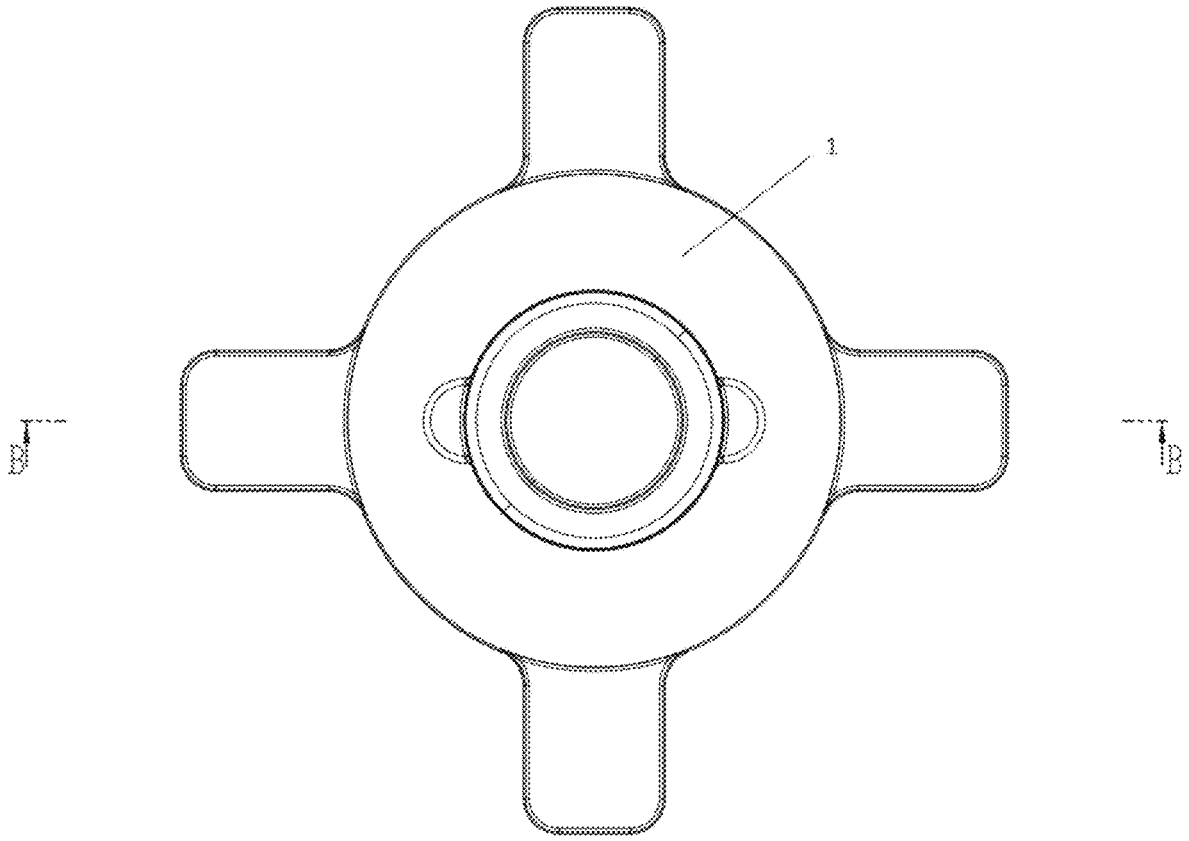
FIG. 5 is a rear view of FIG. 4.

Optionally, as shown in FIG. 3, in the embodiment, a first limiting slot 313 is provided on the first snapping member 31, and one end of the corresponding first elastic member 32 is provided inside the first limiting slot 313, to prevent the first elastic member 32 from being detached from the first snapping member 31.

Optionally, as shown in FIGS. 3 to 4, 6, and 8, in the embodiment, the first limiting protrusion 314 and a pair of second limiting slots 315 are provided on the first snapping member 31.

The first limiting protrusion 314 is provided on the lower side of the first snapping member 31 and the pair of second limiting slots 315 are provided at two ends of the first limiting protrusion 314, when the first limiting protrusion 314 is inserted into the first sliding slot 51, so as to further limit the position and prevent the first snapping member 31 from rotating.

Optionally, as shown in FIGS. 3 to 4, 6, and 8, in the present embodiment, the pressing module 4 comprises:

- a button 41, capable of being reciprocating and sliding within the first channel 12;
- at least one pressing member 42, where one end of the pressing member 42 is fixedly connected to the button 41 and the other end is tapered and connected to the snapping module 3;
- a pair of second snapping members 43, where the pair of second snapping members 43 are respectively disposed on two sides of the pressing member 42, one end is fixedly connected to the button 41 and can be snapped with the front fixing member 1, and the other end is disposed in the second sliding slot 52 and can slide in the second sliding slot 52, to prevent the pressing member 42 from being detached from the first channel 12; and
- a second elastic member 44, where one end of the second elastic member 44 is fixedly connected to the button 41 and the other end of the second elastic member 44 is connected to the front fixing member 1, for resetting the button 41.

Figure 6:
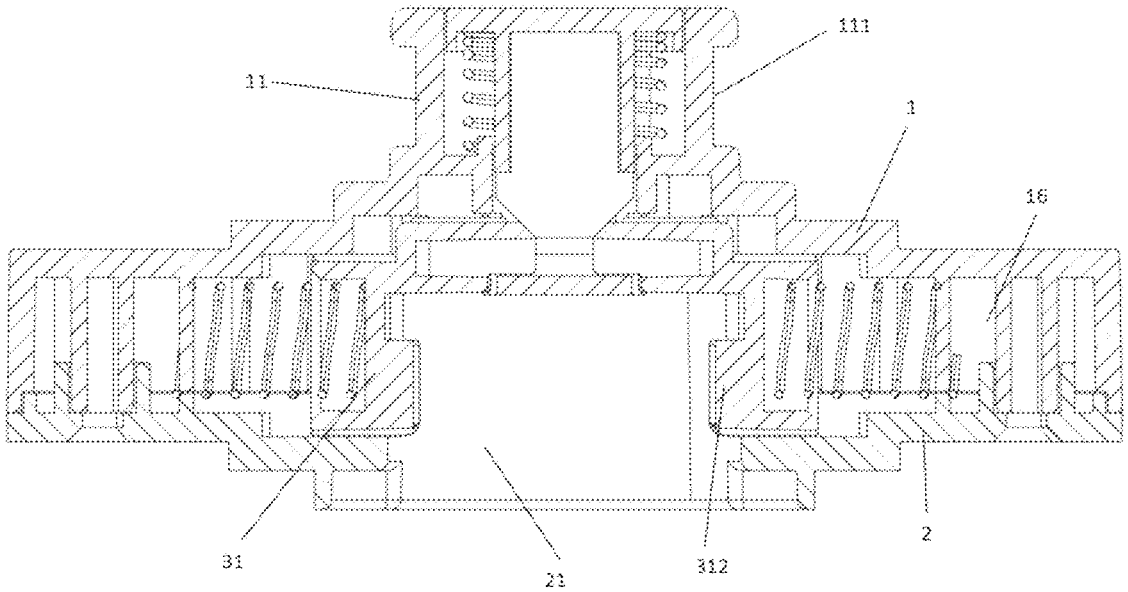
FIG. 6 is a cross-sectional view taken along line B-B of FIG. 5.
Figure 7:
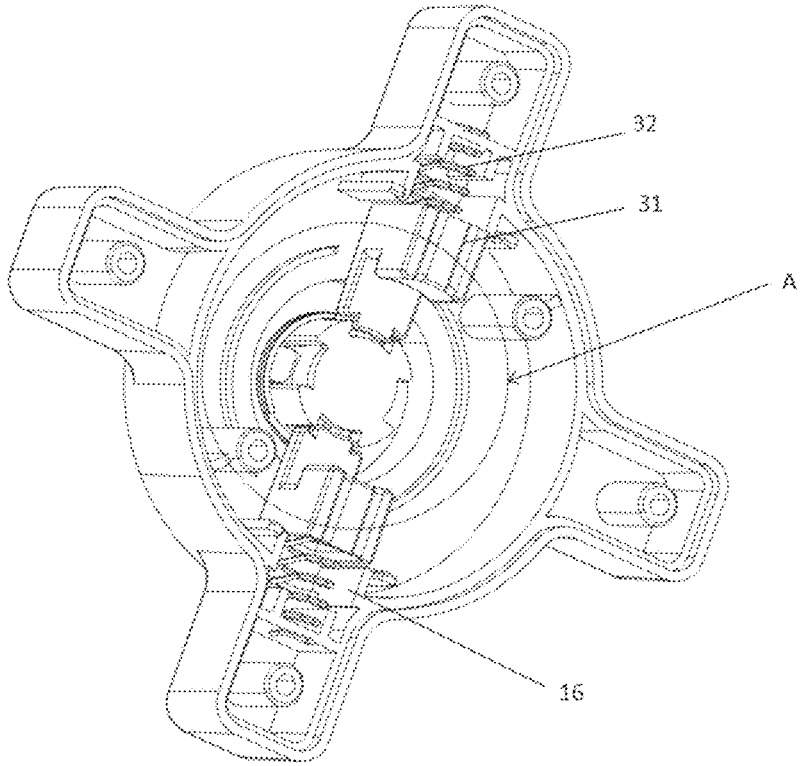
FIG. 7 is a schematic diagram of the internal structure of FIG. 4.
Figure 8:
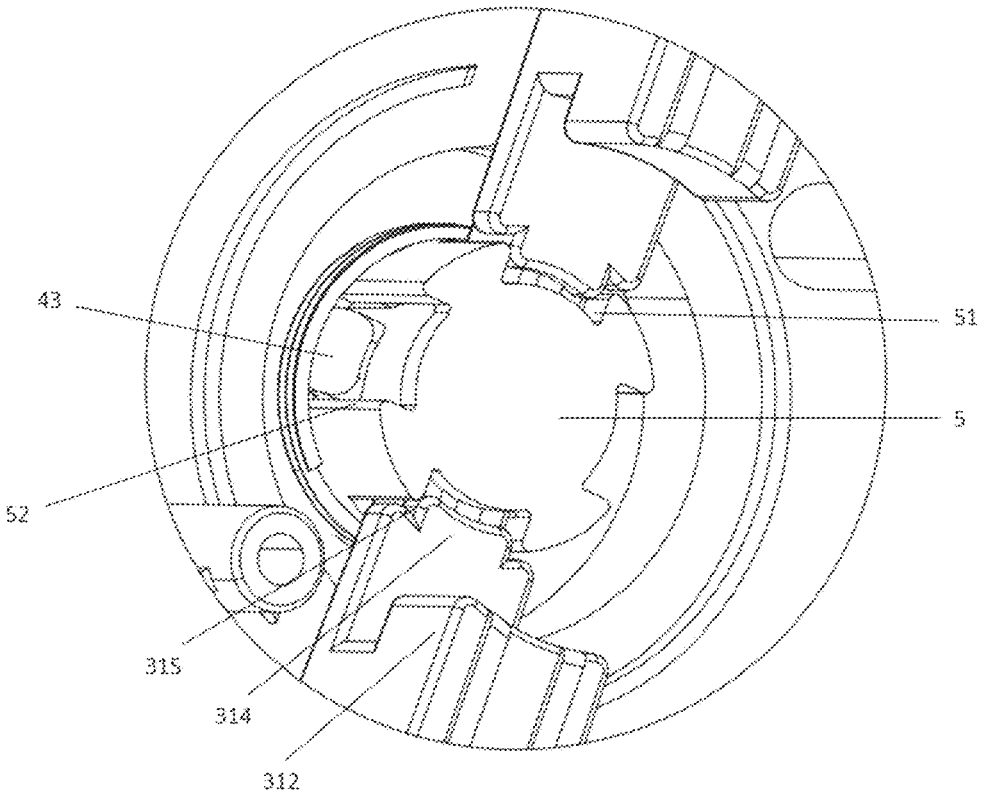
FIG. 8 is an enlarged view at A of FIG. 7.
Figure 9:
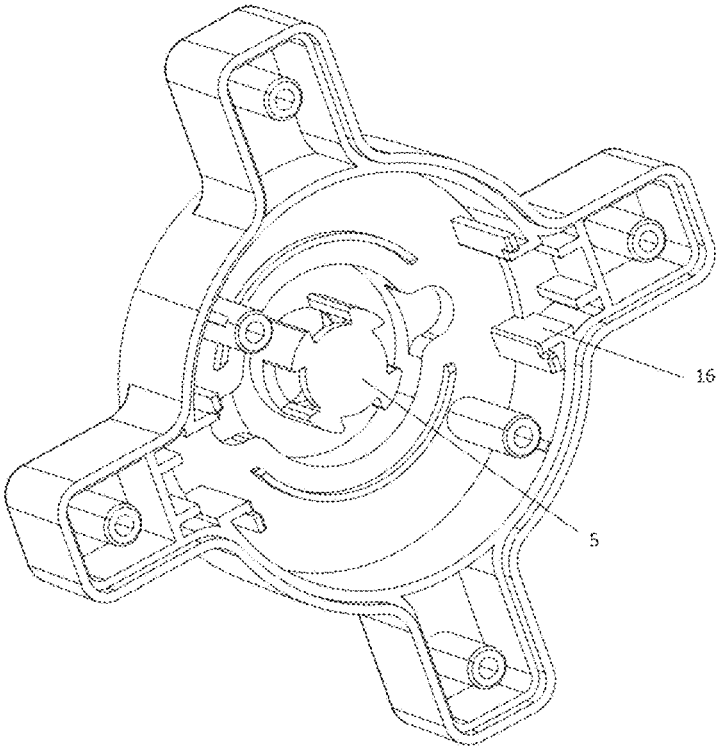
FIG. 9 is an internal schematic view of the front fixing member of the weight plate according to the embodiment of the present disclosure.
Figure 10:
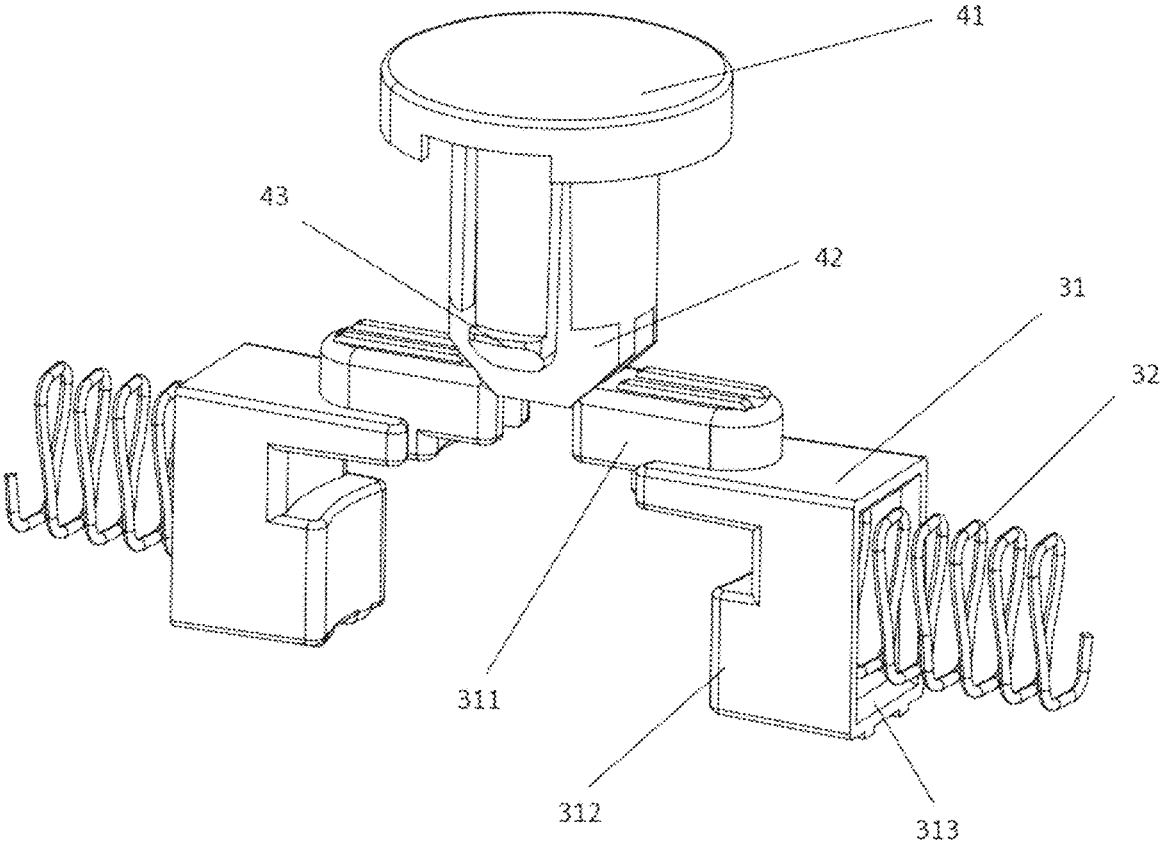
FIG. 10 is a schematic diagram illustrating engagement between the pressing module and the snapping module of the weight plate according to the embodiment of the present disclosure.
Figure 11:
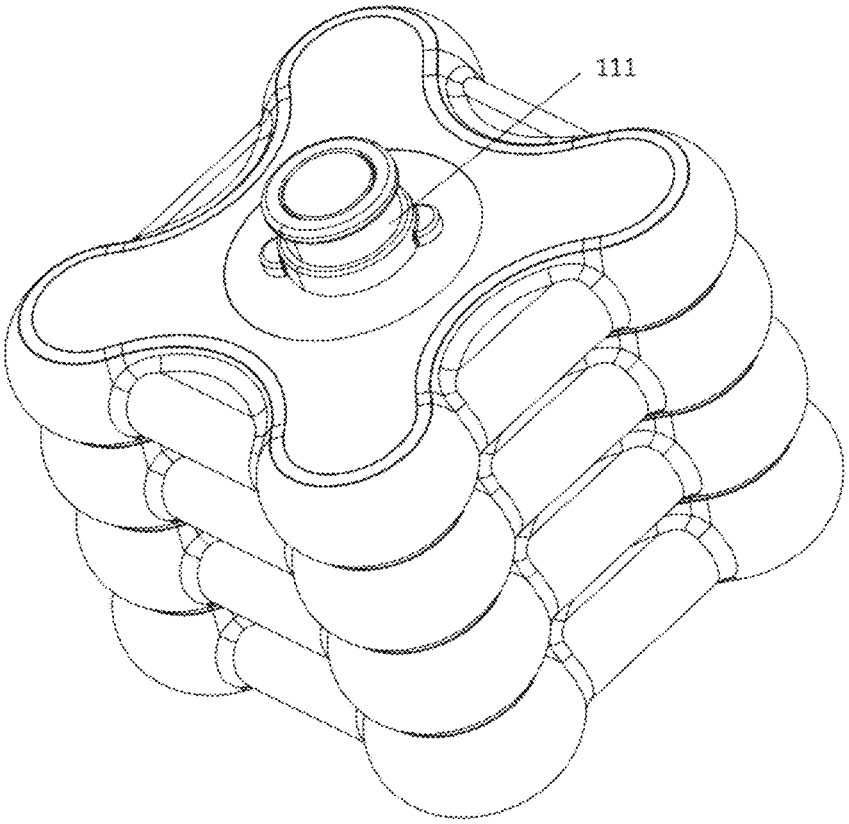
FIG. 11 is a schematic view of the four weight plates snapped together according to the embodiment of the present disclosure.
Figure 12:
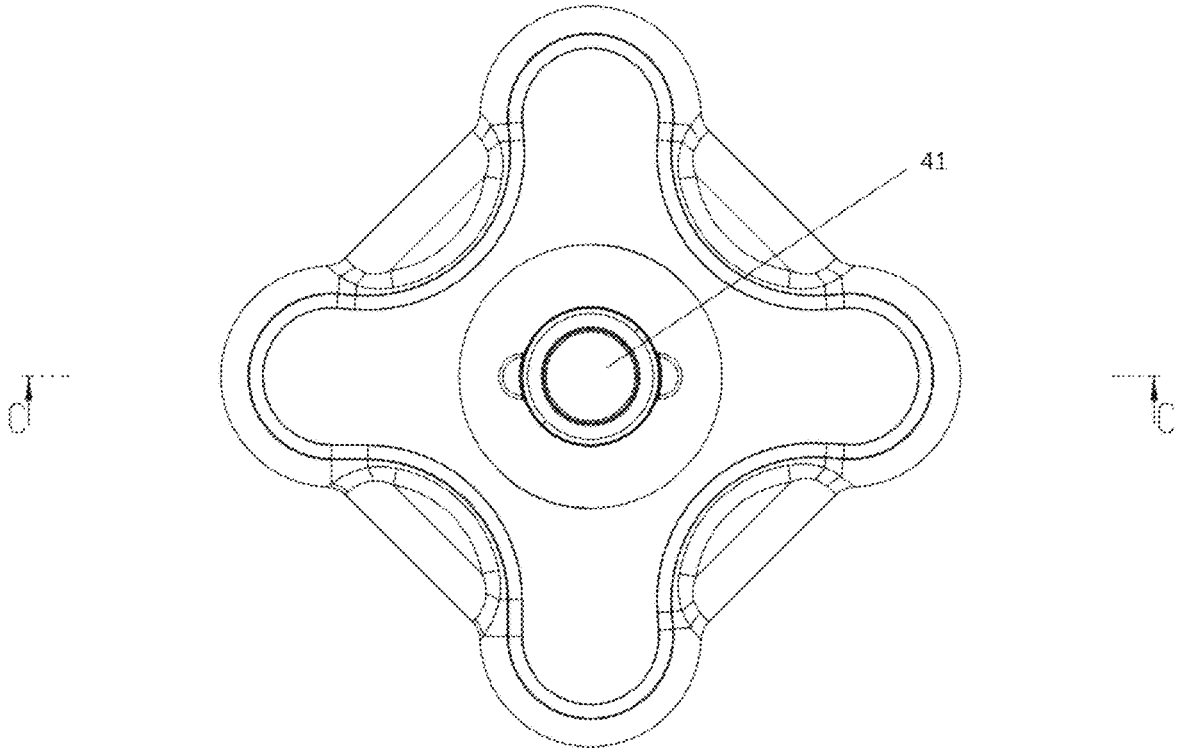
FIG. 12 is a top view of FIG. 10.
Figure 13:
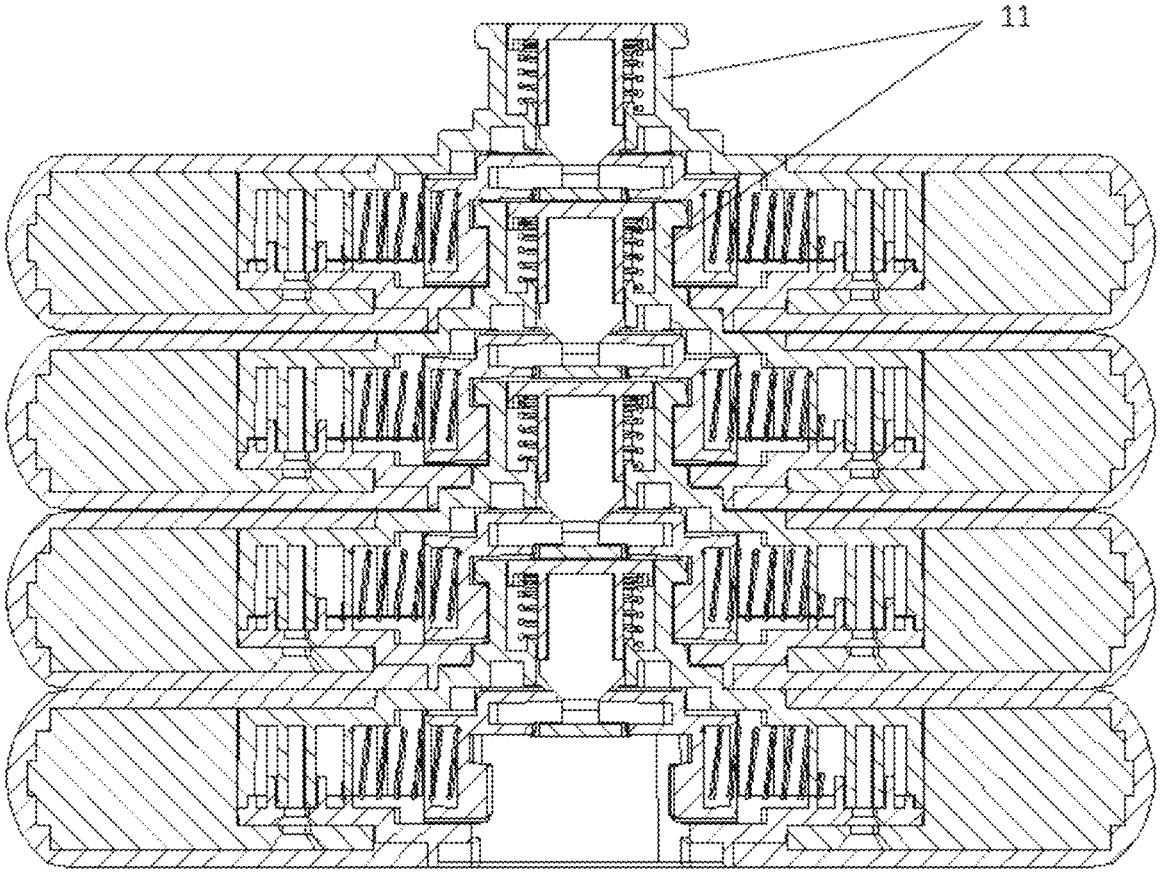
FIG. 13 is a cross-sectional view taken along C-C of FIG. 11.

Optionally, as shown in FIGS. 3 and 6, in the embodiment, the second elastic member 44 is a spring. A first annular protrusion 13 is provided in the first channel 12, the second elastic member 44 is provided between the first annular protrusion 13 and the press button 41, for limiting the position of the second elastic member 44, a second annular protrusion 14 is further provided on the first annular protrusion 13 and one end of the second elastic member 44 close to the first annular protrusion 13 is sleeved on the second annular protrusion 14, so that the second elastic member 44 can be movably connected to the front fixing member 1.

Optionally, as shown in FIG. 1, in the embodiment, two second limiting protrusions 15 are further provided on the front fixing member 1, and a third limiting slot 22 coupled with the second limiting protrusions 15 is provided on the rear fixing member 2, to snap with the second limiting protrusions 15 of the adjacent weight plates, to prevent the adjacent weight plates from rotating after snapped.

Optionally, as shown in FIG. 1, in the embodiment, the weight plate further comprises a weight assembly 6. The weight assembly 6 is connected to the front fixing member 1 and/or the rear fixing member 2, the weight of the weight assembly 6 is adjustable, and the weight of the single weight plate can be controlled by adjusting the quality of the weight assembly 6.

Optionally, as shown in FIG. 3, in the embodiment, the weight plate further comprises a protective cover 7. The protective cover 7 is sleeved on the weight assembly 6 for protecting the weight assembly 6.

Optionally, as shown in FIG. 3, in the embodiment, the front fixing member 1 and/or the rear fixing member 2 are provided with a fourth limiting slot 16, and the snapping module 3 is provided in the fourth limiting slot 16.

The snapping principle between the two weight plates is taken as a example: when the two weight plates are snapped (assuming that one weight plate is a and the other weight plate is b), firstly, the first snapping portion 11 of the weight plate a is inserted into the second channel 21 of the rear fixing part 2 of the weight plate b, and the button 41 of the weight plate b is pushed inward at the same time, the button 41 drives the pressing member 42 to move inward, the second elastic member 44 is compressed, the pressing member 42 squeezes the first driving portions 311, so that the first snapping members 31 moves to two sides (while the first elastic member 32 is compressed), the first snapping portion 11 of the weight plate a is completely inserted into the second channel 21 of the rear fixing member 2 of the weight plate b, the second limiting protrusion 15 on the front fixing member 1 of the weight plate a enters the third limiting slot 22 on the rear fixing member 2 of the weight plate b, release the button 41 of the weight plate b, and the button 41 move back under the action of the second elastic member 44, and at the same time, under the action of the first elastic member 32, the first snapping members 31 are reset, the second snapping portion 312 is snapped into the first snapping recess 111 of the first snapping portion 11 of the weight plate b, the first limiting protrusion 314 of the weight plate b is inserted into the first sliding slot 51, and at this time, the two weight plates are snapped.

As mentioned above, as shown in FIGS. 1 to 12, the weight plate according to the embodiment of the disclosure has a simple structure and low cost. A plurality of weight plates can be snapped to each other, which has strong adaptability and replaceability. The weight for the bodybuilder can be adjusted by adjusting the number of the snapped weight plates. At the same time, the weight of one single weight plate can be controlled by adjusting the quality of the weight assembly.

It should be noted that in this specification, the terms "comprises", "comprising", or any other variation thereof are intended to encompass a non-exclusive inclusion such that a process, method, article, or apparatus that comprises a series of elements comprises not only those elements, but also other elements that are not explicitly listed, or elements inherent to such a process, method, article, or apparatus. Without further limitation, an element defined by the statement "comprises" does not preclude the presence of additional identical elements in a process, method, article, or apparatus that comprises the element.

Although the content of the present disclosure has been described in detail with reference to the above embodiment, it should be recognized that the foregoing description should not be construed as limiting the disclosure. Numerous modifications and alternatives to the present disclosure will be apparent to those skilled in the art upon reading the foregoing. Accordingly, the scope of protection of the present disclosure should be defined by the appended claims.

What is claimed is:

1. A weight plate, comprising:

a front fixing member, provided with a first snapping portion and a first channel, wherein the first channel penetrates the first snapping portion, and the first snapping portion is provided with a first snapping recess;

a rear fixing member, fixedly connected to the front fixing member and provided with a second channel;

a snapping module, movably disposed between the front fixing member and the rear fixing member, wherein the first snapping portion of an adjacent weight plate is capable of being inserted into the second channel to be snapped with the snapping module;

a pressing module, movably connected to the front fixing member through the first channel, to drive the snapping module to open and close; and a first limiting sleeve, sleeved on the pressing module and fixedly connected to the front fixing member, for limiting a maximum stroke of the pressing module, wherein a pair of first sliding slots and a pair of second sliding slots are disposed on two opposite sides of the first limiting sleeve;

wherein the snapping module comprises:

a pair of first snapping members, wherein an upper end of each of the first snapping members is provided with a first driving portion and a lower end of each of the first snapping members is provided with a second snapping portion, the first driving portion is connected to the pressing module, and the second snapping portion is connected to the first snapping recess of the adjacent weight plate; and a pair of first elastic members, wherein the pair of first elastic members are one-to-one corresponding to the pair of first snapping members, and are disposed between the corresponding first snapping members and the front fixing member or the rear fixing member, for resetting the corresponding first snapping member;

wherein the pressing module comprises:

a button capable of being reciprocated and sliding inside the first channel;

at least one pressing member, wherein one end of the pressing member is fixedly connected to the button, and the other end of the pressing member is tapered and connected to the snapping module;

a pair of second snapping members, wherein the pair of second snapping members are respectively disposed on two sides of the pressing member, one end of each of the second snapping members is fixedly connected to the button, and the other end of each of the second snapping members is snapped with the front fixing member to prevent the pressing member from being detaching from the first channel; and a second elastic member, wherein one end of the second elastic member is connected to the button, and the other end of the second elastic member is connected to the front fixing member, for resetting the button.

2. The weight plate according to claim 1, wherein the first snapping member is provided with a first limiting slot and one end of the corresponding first elastic member is provided in the first limiting slot.

3. The weight plate according to claim 2, wherein the pressing module comprises:

a button capable of being reciprocated and sliding inside the first channel;

at least one pressing member, wherein one end of the pressing member is fixedly connected to the button, and the other end of the pressing member is tapered and connected to the snapping module;

a pair of second snapping members, wherein the pair of second snapping members are respectively disposed on two sides of the pressing member, one end of each of the second snapping members is fixedly connected to the button, and the other end of each of the second snapping a members is snapped with the front fixing member to prevent the pressing member from detaching from the first channel; and a second elastic member, wherein one end of the second elastic member is connected to the button, and the other end of the second elastic member is connected to the front fixing member, for resetting the button.

4. The weight plate according to claim 3, wherein the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

5. The weight plate according to claim 2, wherein the front fixing member is further provided with at least one second limiting protrusion, and the rear fixing member is provided with a third limiting slot coupled with the second limiting protrusion.

6. The weight plate according to claim 2, further comprising:

a weight assembly connected to the front fixing member and/or the rear fixing member and a weight of the weight assembly is adjustable.

7. The weight plate according to claim 1, wherein the first snapping member is provided with a first limiting protrusion and a pair of second limiting slots;

wherein the first limiting protrusion is disposed on a lower side of the first snapping member and the pair of second limiting slots are disposed at two ends of the first limiting protrusion.

8. The weight plate according to claim 1, wherein the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

9. The weight plate according to claim 1, wherein the front fixing member is further provided with at least one second limiting protrusion and the rear fixing member is provided with a third limiting slot coupled with the second limiting protrusion.

10. The weight plate according to claim 1, further comprising:

a weight assembly connected to the front fixing member and/or the rear fixing member and a weight of the weight assembly is adjustable.

11. The weight plate according to claim 10, further comprising:

a protective cover sleeved on the weight assembly.

12. The weight plate according to claim 1, wherein the front fixing member and/or the rear fixing member are provided with a fourth limiting slot, and the snapping module is provided inside the fourth limiting slot.

13. The weight plate according to claim 1, wherein the pressing module comprises:

a button capable of being reciprocated and sliding inside the first channel;

at least one pressing member, wherein one end of the pressing member is fixedly connected to the button, and the other end of the pressing member is tapered and connected to the snapping module;

a pair of second snapping members, wherein the pair of second snapping members are respectively disposed on two sides of the pressing member, one end of each of the second snapping members is fixedly connected to the button, and the other end of each of the second snapping a members is snapped with the front fixing member to prevent the pressing member from detaching from the first channel; and a second elastic member, wherein one end of the second elastic member is connected to the button and the other end of the second elastic member is connected to the front fixing member, for resetting the button.

14. The weight plate according to claim 13, wherein the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

15. The weight plate according to claim 1, wherein the front fixing member is further provided with at least one second limiting protrusion, and the rear fixing member is provided with a third limiting slot coupled with the second limiting protrusion.

16. The weight plate according to claim 1, further comprising:

a weight assembly connected to the front fixing member and/or the rear fixing member and a weight of the weight assembly is adjustable.

17. The weight plate according to claim 16, further comprising:

a protective cover sleeved on the weight assembly.

18. The weight plate according to claim 1, wherein the front fixing member and/or the rear fixing member are provided with a fourth limiting slot, and the snapping module is provided inside the fourth limiting slot.

* * * * *